United States Patent [19]

Sjöbom

[11] 4,301,974

[45] Nov. 24, 1981

[54] REFINING APPARATUS

[75] Inventor: Axel H. Sjöbom, Njurunda, Sweden

[73] Assignee: Sunds Defibrator Aktiebolag, Sweden

[21] Appl. No.: 98,826

[22] Filed: Nov. 30, 1979

[30] Foreign Application Priority Data

Dec. 1, 1978 [SE] Sweden ..... 7812397

[51] Int. Cl.[3] ..... B02C 7/11

[52] U.S. Cl. ..... 241/244; 241/251

[58] Field of Search ..... 241/244–248, 241/259.1, 259.2, 261.2, 261.3, 251

[56] References Cited

U.S. PATENT DOCUMENTS 3,207,450 9/1965 Horstman ..... 241/251
4,221,343 9/1980 Skeen ..... 241/251 X

FOREIGN PATENT DOCUMENTS 974958 9/1975 Canada .
1052156 4/1979 Canada .
2183928 12/1973 Fed. Rep. of Germany ..... 241/244
2713300 5/1978 Fed. Rep. of Germany .
7315217 11/1973 Switzerland .
641298 8/1950 United Kingdom ..... 241/247

*Primary Examiner*—Mark Rosenbaum
*Attorney, Agent, or Firm*—Lerner, David, Littenberg & Samuel

[57] ABSTRACT

Apparatus for refining lignocellulose-containing material is disclosed, including a refiner housing, a pair of counter-rotating refining discs within the housing, one of the discs including a feed passage for refining stock and the other disc including a steam passage therethrough to permit steam to exit from the refining space between the discs, channel means rotatable with that refining disc which includes the steam passage in order to conduct steam therefrom through the refiner housing, and passage means located outside of the refiner housing for conducting away steam exiting from the channel means.

7 Claims, 1 Drawing Figure

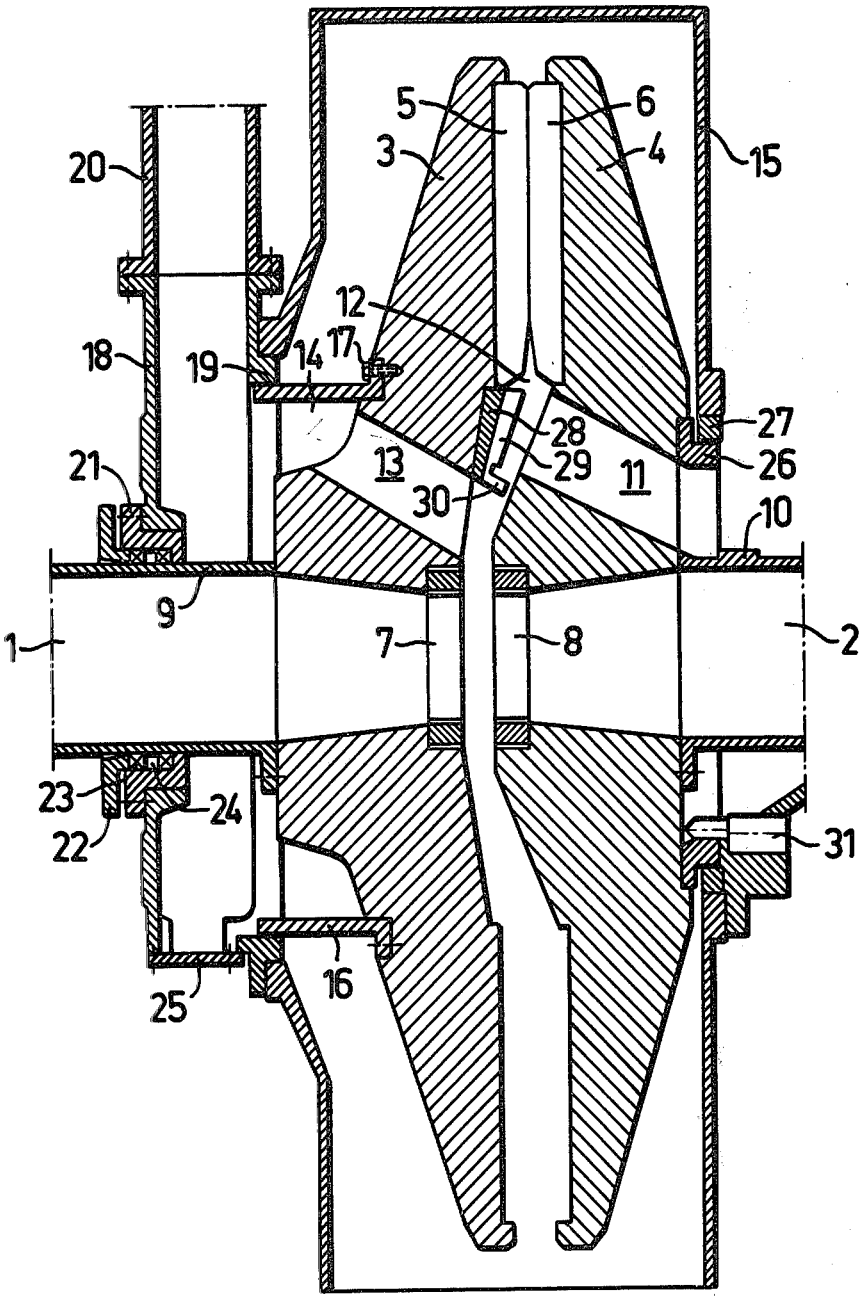
5
6
3
4
15
20
12
17
14
18
19
28
27
29
26
13
11
21
30
10
9
1
7
8
2
23
24
22
31
16
25

REFINING APPARATUS

FIELD OF THE INVENTION

The present invention relates to apparatus for refining lignocellulose-containing material. More particularly, the present invention relates to such apparatus including two refining discs rotable with respect to each other. Still more particularly, the present invention relates to such apparatus in which one of the refining discs includes an inlet passage located near the center of the disc for feeding the lignocellulose-containing material into the space between the disc which defines a refining space where lignocellulose-containing material is processed as it passes outwardly to the surrounding refiner housing.

BACKGROUND OF THE INVENTION

In known apparatus of the type described above, problems arise in certain refining processes in view of the fact that an overpressure is created between the refining surfaces which can disturb the material-feeding process. At times this overpressure between the refining surfaces can undesirably prevent the lignocellulose-containing material from being subjected to the necessary processing pressures. In other cases, this overpressure can in some other ways disturb the refining process. Furthermore, pressure variations between the refining surfaces can occur, and thereby affect the process by disturbing the stability of the gap therebetween.

During the refining of wood chips, for example, where pieces of cellulosic material are centrally charged between two contra-rotating refining discs, the wood chips generally contain water, since they are usually steamed with hot water and/or steam. Some water is also added in connection with the refining process itself. Because during the refining operation only a portion of the energy supplied is consumed by the refining process itself, large amounts of steam are produced from this water. The resulting steam pressure then renders it difficult to charge additional chips when this steam must flow outwardly through the same inlet through which the chips are charged. Moreover, steam shocks occur and adversely affect the refining process by disturbing the gap stability.

In certain conventional refiners, such as that shown in Swedish Patent Application No. 7701182-3, which corresponds to U.S. patent application Ser. No. 656,003, now abandoned, which is the parent of application Ser. No. 865,176, which issued as U.S. Pat. No. 4,221,343 on Sept. 9, 1980, channels are provided through one of the refining discs to conduct steam away from the space between the refining discs. The steam is then permitted to flow from the rear side of the refining disc within the refiner housing to the outside of the housing through a stationary steam-collecting device provided in the housing. In this type of structural design significant problems arise, however, particularly with respect to the maintenance of a seal between the rotating discs and the stationary steam-collecting device. Such a seal must then be located within the refiner housing, which results in a considerable risk of clogging, while at the same time this renders it difficult to obtain access to the seal, such as for cleaning purposes. Furthermore, such a steam-collecting device has a disturbing effect on the flow of the refined stock in the refiner housing, rendering it difficult to axially move the refiner discs, and thereby difficult to obtain access when, for example, there is a need to exchange the refining surfaces (refining segments) of the refiner discs. It is an object of the present invention to eliminate the aforesaid disadvantages.

SUMMARY OF THE INVENTION

In accordance with the present invention, these and other objects have now been solved by providing an apparatus for refining lignocellulose-containing material which comprises a refining housing, first and second juxtaposed refining disc members rotatably mounted within the refiner housing, each of the first and second refining disc members including an inner surface and an outer surface, the refining disc members furthermore being mounted so that their inner surfaces are in opposed face-to-face relationship defining a refining space therebetween, a feed passage extending through the first refining disc member from its outer surface to its inner surface for feeding the lignocellulose-containing material to the refining space, a steam passage extending through the second refining disc member from its outer surface to its inner surface so as to permit steam generated in the refining space to pass therefrom to a point within the refining housing, channel means rotatable with the second refining disc member for conducting steam from the outer surface of the second refining disc member through the refiner housing, and passage means located outside the refining housing for conducting away steam exiting from the channel means, wherein the passage means is sealingly connected to the channel means to prevent the leakage of steam therefrom.

In accordance to one of the embodiments of the present invention, the steam passage extends from a point on the inner surface of the second refining disc member located radially inwardly with respect to the point on the inner surface of the first refining disc member from which the feed passage extends. In a preferred embodiment, the channel means comprises a cylindrical annular shield which is affixed to the outer surface of the second refining disc member.

In accordance with another embodiment of the present invention in which the refiner housing includes an outer wall, sealing means are provided for sealingly connecting the channel means to the passage means, the sealing means preferably comprising a cylindrical gap seal formed between the rotatable channel means and a point on the outer wall of the refiner housing so that the second refining disc member can be moved axially towards the outer wall of the refining housing without interference thereby. Preferably, that point on the outer wall of the refiner housing is defined by the passage means.

In accordance with another embodiment of the present invention, this apparatus includes a plurality of radially projecting bar members on the inner surface of the second refining disc member, these bar members being located radially outwardly with respect to the point on the inner surface of the second refining disc member from which the steam passage extends so that the bar members can assist in moving the lignocellulose-containing material radially outward through the refining space.

In accordance with a preferred embodiment of the present invention, these plurality of bar members include projecting means extending towards the inner surface of the first refining disc member in order to prevent the flow of lignocellulose-containing material radially inwardly in the refining space towards the steam passage while at the same time permitting steam to flow in that direction into the steam passage from the refining space.

BRIEF DESCRIPTION OF THE DRAWING

The present invention can be more fully understood with reference to the drawing, which is a sectional side view of the apparatus of the present invention.

DETAILED DESCRIPTION

Referring now to the drawing, one embodiment of a refining apparatus in accordance with this invention is shown, including two rotatable shafts 1,2 carrying refining discs 3,4. These refining discs carry refining segments 5,6 and are retained on the shafts 1,2 by locking nuts 7,8. In the embodiment shown, the refining discs 3,4 are adapted for counter-rotation. The shafts are also provided with wear sleeves 9,10. Feed passages 11 are provided in the refining disc 4, and the cellulose material is fed therefrom in the form of pieces (chips) centrally between the refining discs 3,4. The chips are thus fed into the refining space 12 between discs 3,4, and move radially outward through the gap between the refining segments 5,6.

The refining disc 3 is provided with at least one opening or steam passage 13, which extends to a space 14 within the refiner housing 15, but at the same time being shielded from the interior of housing cover 15 by an annular shield 16. The shield 16 is attached by means of screws 17 to the refining disc 3, and is thus rotatable together with that disc. At its opposite end the annular shield 16 is sealingly attached to an end wall portion of the housing cover 15, or to an end wall housing 18. In any event, this sealed attachment is in this case established by a narrow gap 19 therebetween. The steam formed during refining is then conducted away through a steam conduit 20, and can be advantageously utilized for the preheating of unprocessed chips, etc.

The end wall of housing 18 is sealed against the ambient by a stuffing box means consisting of a box housing 21, a gland 22 and gaskets 23. The gaskets 23 are conventionally held apart by a ring 24 so that sealing water can be supplied between the gaskets 23. At the bottom of the end wall housing 18 a detachable cover 25 is provided for cleaning purposes.

The refiner housing 15 is also sealed on the side where the stock is supplied (the right side of the refiner housing as seen in the drawing). The gap sealing shown here in the drawing consists of a guide ring 26 and a sealing ring 27 cooperating therewith.

On the refiner disc 3 a so-called wear ring 28 is provided, and is formed with a plurality of bars 29 in order to ensure that material introduced into the space 12 is moved or thrown into the refining gap between the refining segments 5,6. A suitable number of such bars 29 is from about 2 to 10. On the wear ring 28 are also provided a number of projecting members 30, e.g., from about 2 to 16, hich may have an extension of 25 to 100 mm in the circumferential direction, i.e., facing towards the inner surface of refiner disc 4. These projecting members, which extend closely adjacent to refining disc 4, are intended to constitute a lock against radially inward movement of the lignocellulose-containing material, while at the same time permitting steam to flow in that direction to steam passages 13. One or more cleaning plugs 31 can be provided for cleaning the feed passages 11, and diluting liquor and/or chemicals can also be supplied therethrough for bleaching during the refining process.

During the refining of chips, etc., this apparatus operates as follows: Chips are supplied to the feed passages 11 from a feed funnel (not shown) or the like. With the assistance of bars 29, the chips are moved into the refining gap, and because of the high speed of rotation of the refining discs (generally from about 1200 to 1500 rpm) the projecting members 30 form a "wall" which prevents even single chip pieces from moving inwardly. The projecting members 30 do not, however, constitute an appreciable obstruction to the radially inward flow of gas (the steam formed during refining). The steam thus leaves through the openings 13 to the space 14 within the refiner housing, and then continues to the end wall housing 18 for further removal. Under certain circumstances, projecting members 30 can be eliminated since the channels 13 extend from a position radially inward with respect to feed passages 11.

A number of important advantages are thus gained by employing this invention. The annular shield 16 ensures that chips which may not have been processed do not enter the refiner housing cover and become mixed with refined stock. The sealing means 19 in connection with the annular shield is located at a position at the end portion of the refiner housing cover which is protected. The sealing process is thus formed as a cylindrical gap sealing, and the refining disc 3 can thus be easily moved in the axial direction without the need for any dismantling, such as when the segments are to be exchanged. The length of the annular shield 16 is thus selected so as to render such exchange easy. Due to the cylindrical form of the annular shield 16, as well as to its rotation, deposits of refined material on that shield are entirely eliminated.

The invention is not restricted to the embodiment shown, but that embodiment merely is an example of an apparatus in accordance with the inventive concept, which is defined in the attached claims.

I claim:

1. Apparatus for refining lignocellulose-containing material comprising a refiner housing, first and second refining disc members rotatably mounted within said refiner housing, each of said first and second refining disc members including an inner surface and an outer surface, said refining disc members being mounted so that said inner surfaces of said refining disc members are in opposed face-to-face relationship defining a refining space therebetween, a feed passage extending from said outer surface of said first refining disc member to said inner surface of said first refiner disc member for feeding said lignocellulose-containing material to said refining space, a steam passage extending from said outer surface of said second refining disc member to said inner surface of said second refining disc member so as to permit steam generated in said refining space to pass from said refining space to a point within said refiner housing, channel means rotatable with said second refining disc member for conducting steam from said outer surface of said second refining disc member entirely through said refiner housing, and passage means located entirely outside of said refiner housing for conducting away steam exiting from said channel means, said passage means being sealingly connected to said channel means to prevent leakage of steam therefrom.

2. The apparatus of claim 1 wherein said steam passage extends from a point on said inner surface of said second refining disc member located radially inward with respect to said point on said inner surface of said first refining disc member from which said feed passage extends.

3. The apparatus of claim 1 wherein said channel means comprises a cylindrical annular shield affixed to said outer surface of said second refining disc member.

4. The apparatus of claim 1 wherein said refiner housing includes an outer wall, and including sealing means for sealingly connecting said channel means to said passage means, said sealing means comprising a cylindrical gap seal formed between said rotatable channel means and a point on said outer wall of said refiner housing, whereby said second refining disc member can be moved axially towards said outer wall of said refining disc member.

5. The apparatus of claim 4 wherein said point on said outer wall of said refiner housing is defined by said passage means.

6. The apparatus of claim 1 including a plurality of radially projecting bar members on said inner surface of said second refining disc member, said bar members being located radially outward with respect to said point on said inner surface of said second refining disc member from which said steam passage extends so that said bar members can assist in moving said lignocellulose-containing material radially outward through said refining space.

7. The apparatus of claim 6 wherein said plurality of bar members includes projecting means extending from said bar members towards said inner surface of said first refining disc member so as to prevent the flow of said lignocellulose-containing material radially inward through said refining space towards said steam passage while permitting steam to flow into said steam passage from said refining space.

* * * * *